US005136747A

United States Patent [19]

McCaughan et al.

[11] Patent Number: 5,136,747

[45] Date of Patent: Aug. 11, 1992

[54] PROTECTIVE SHIELD FOR A CLEANING APPARATUS

[76] Inventors: James L. McCaughan, 13206 Paradise Valley Dr., Houston, Tex. 77069; Richard D. DiBene, 12618 Misty Valley Dr., Houston, Tex. 77066

[21] Appl. No.: 529,903

[22] Filed: May 25, 1990

[51] Int. Cl.[5] ..... A47L 9/00

[52] U.S. Cl. ..... 15/247; 15/325

[58] Field of Search ..... 15/325, 247, 257.1

[56] References Cited

U.S. PATENT DOCUMENTS 4,437,204 3/1984 Gühne ..... 15/325
4,831,682 5/1989 White ..... 15/325
4,876,762 10/1989 Foster ..... 15/325 X

FOREIGN PATENT DOCUMENTS 3403800 8/1985 Fed. Rep. of Germany ..... 15/325

*Primary Examiner*—Chris K. Moore
*Attorney, Agent, or Firm*—Ezra L. Schacht

[57] ABSTRACT

A protective "bumper cover" for vacuum cleaners, used by janitorial building personnel in commercial locations to prevent damage to conventional office furniture and walls, has a top and sides made of a tough moldable plastic material, for example, a polyurethane, which can be molded with a resilient inner layer and a tough outer "skin," the inner layer yielding in the case of impact with furniture, thus absorbing the collision energy, the outer "skin" resisting cutting and damage to the bumper cover due to such impact. Apertures in the cover provide access to adjustment screws and for inspection of the driving motor brushes. Straps molded integrally with the cover can be secured to the vacuum cleaner itself at various suitable anchoring points.

2 Claims, 1 Drawing Sheet

PROTECTIVE SHIELD FOR A CLEANING APPARATUS

BACKGROUND OF THE INVENTION

Protective strips fastened to the sides of vacuum cleaners, to prevent damage to furniture in the home by careless bumping with residential sized vacuum cleaners, are old in the art. Such strips or cushioning devices have, in the past, been made of extruded elastomeric tubing, some extruded with projections that can be locked into apertures in the sides of the vacuum cleaner casing.

Tank type vacuum cleaners, rolling on casters or sliding on rails behind a hose-connected suction wand, have in one prior art patent had the cylindrical tank wrapped with a blanket of unspecified material to protect walls, furniture, and the cleaning tank itself from damage due to impact during cleaning.

The necessity to protect office furniture, while high speed janitorial cleanup is performed during nonworking hours in highrise commercial buildings, creates a problem of much greater scope and magnitude.

The sidemounted tubing strips cannot survive the repetitive battering of continuous office cleaning, as can be seen by inspection of conventional vacuum cleaners used for a short period of time in such buildings. Furthermore, the rigid hard top of the cleaner frequently strikes the front lower edge of furniture, when such an edge is a few inches above the floor. This causes unsightly damage to a highly visible part of the furniture.

The construction of modern wall to wall carpeting, fabricated of synthetic wear resistant fiber, also causes wear on the underside of the vacuum cleaner and, if the "bumper strip" is mounted close to the floor, contact with the hard rough fibers of the carpet can cause degradation and wear of the strip.

If covers are made of a combination of padding and an outer canvas sheath, the continuous wear of the canvas results in the formation of filamentary wear products, which can clog the beater brushers and require tedious hand removal of filaments or threads from the brushes.

A protective "bumper cover" for the vacuum cleaner of the present invention, which can prevent damage to conventional office furniture has a top and sides made of a single layer of some tough moldable non-porous plastic material, for example, a polyurethane, which can be molded with a resilient inner core and a tough outer "skin," the inner core yielding in the case of impact with furniture, the outer "skin" resisting cutting and damage to the bumper cover due to such impact.

It must be understood that a large number of such identical cleaners may be in use by a building maintenance organization in a number of buildings. "Bumpable" covers for such "a fleet" of cleaning machines may therefore be molded in a compression molding press. Apertures or means for: inspection of electric motor brushes; access to screws for adjustment of height of cleaner brushes above the carpet surface; ventilation of electric motors; intake and discharge of suction air, and other uses, all may be incorporated within the cover during the molding process.

Means for securing the bumper cover to the vacuum cleaner itself may also be molded integrally with the cover to eliminate the possibility of the cover being accidentally detached from the cleaner during periods of heavy use.

PREFERRED EMBODIMENT OF THE INVENTION

Figure 1:
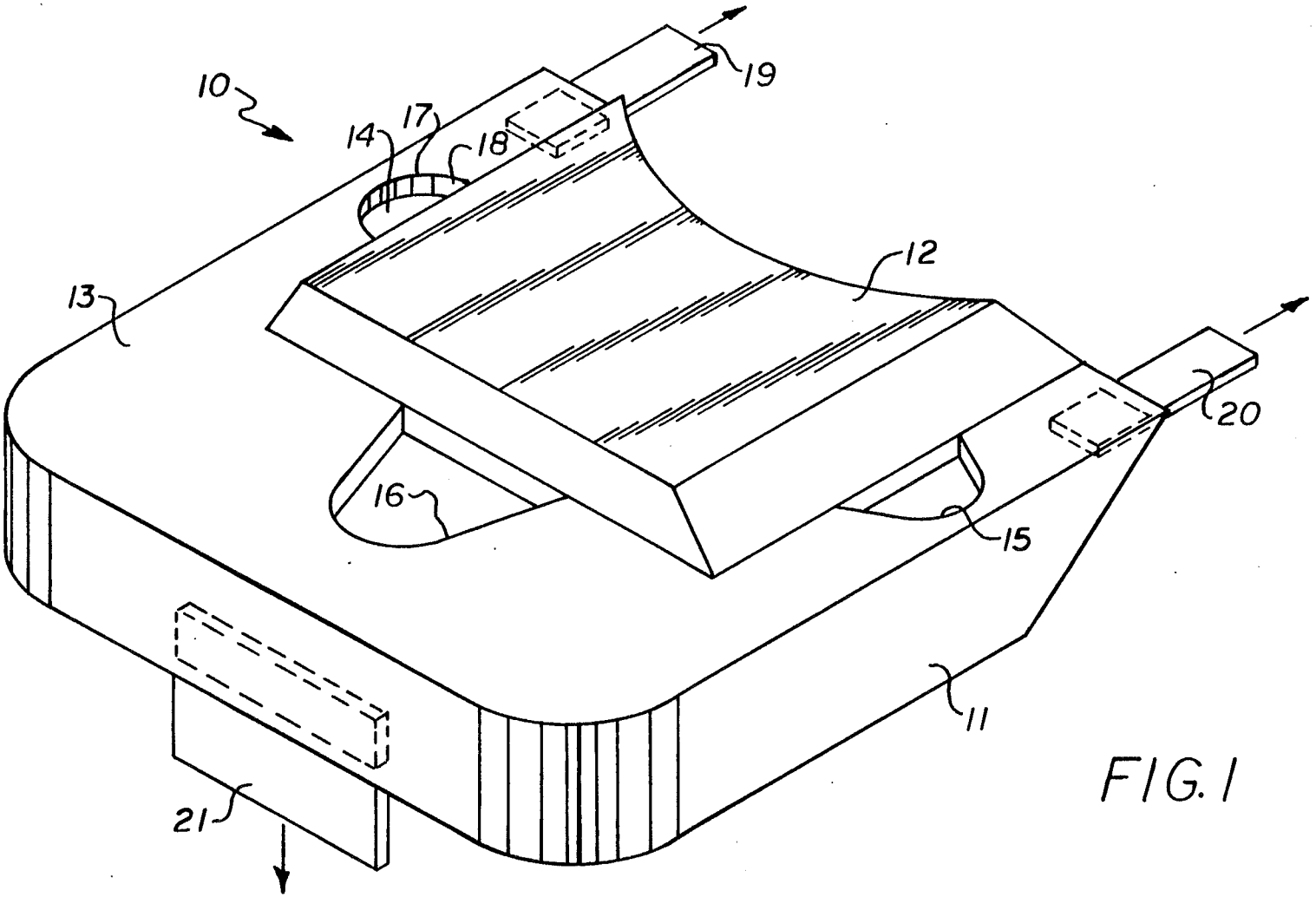
FIG. 1 is a pictorial view of a typical cover, showing the dual wall construction, inspection and access apertures, and integrally molded securing tapes.

FIG. 1 is a pictorial view of a typical cover 10, molded with a lower walllike section 11, which encloses the front and two sides of the vacuum cleaner, and provides protection for direct impact against furniture and walls. The upper portion 12 covers the "superstructure" of the vacuum cleaner and in general wall be molded for a specific machine. It is joined to the lower section 11 by a generally flat uniformly thick section 13, all integrally molded at one time. It is also possible to mold typical apertures 14 and 15, for electric motor brush inspection, and aperture 16 for adjustment of vacuuming brush and intake nozzle height, as well as other apertures and recesses, in wall section 13.

In the aperture 14–16 may be seen the cross sectional construction of the wall, comprised of a thin tough polyurethane skin 17 and a thicker softer energy absorbing polyurethane layer 18.

Also embedded within the molded dover 10 are means for securing it to the vacuum cleaner 19–21, against the rigors of high speed cleaning. Such means of attachment may be of metal or plastic, flexible or rigid, and with terminations best suited for securing cover 10 to the cleaner. One such means is nylon webbing, which gives flexibility with strength, and may be terminated with eyelets, hooks and many other devices, most practical for such attachment in the specific case, and known to those skilled in the art.

This may be especially useful with securing means 21, which may be made of very thin nylon mesh, since its length can be almost the full length of the nozzle, and if the mesh 21 is thin enough, it can be clamped between the front rim of the vacuum cleaner nozzle and the perforated metal plate which guards against injury or damage from the spinning cylindrical brush. The vacuum cleaner and its parts mentioned in the foregoing sentence are conventional and not shown in FIG. 1.

What is claimed is:

1. An improved furniture-protective cover for a vacuum cleaner, the cleaner of a type used on floors and carpets in commercial buildings, the cleaner having:

a top, a bottom, and generally vertically external side walls;

a nozzle making suction contact with the floor covering material, the nozzle equipped with a conventional carpet beater-brush and a detachable apertured guard plate therefor in said bottom, the cover comprised of:

a single layer of homogeneous material that provides both cushioning and energy absorption, said cover extending over the sides and top of said cleaner, said material being of such a nature that the surface of said cover will wear at point of contact with said floor covering without forming filamentary wear products; and means for attaching said cover to said cleaner.

2. An improved furniture-protective cover for a vacuum cleaner, the cleaner of a type used on floors and carpets in commercial buildings, the cleaner having:

a top, a bottom, and generally vertical external side walls;

a nozzle making suction contact with the floor covering material, the nozzle equipped with a conventional carpet beater-brush;

the bottom of the vacuum cleaner having at least one aperture for the projecting of the supporting wheels, and means for securing the apertured guard plate of said beater-brush, said cover having integral therewith;

a plurality of attachment members, including at least one secured to the front of said cover and made of mesh thin enough to be clamped between the lower front rim of said nozzle housing and said apertured guard plate.

* * * * *